US008499416B2

(12) United States Patent
Settsu et al.

(10) Patent No.: US 8,499,416 B2
(45) Date of Patent: Aug. 6, 2013

(54) DOOR CHECK LINK APPARATUS FOR VEHICLE

(75) Inventors: Yoshiharu Settsu, Yokohama (JP); Toshihisa Nishijo, Yokohama (JP); Toku Fukaya, Yokohama (JP)

(73) Assignee: Mitsui Kinzoku Act Corporation, Yokohama-shi (JP)

( * ) Notice: Subject to any disclaimer, the term of this patent is extended or adjusted under 35 U.S.C. 154(b) by 0 days.

(21) Appl. No.: 13/424,723

(22) Filed: Mar. 20, 2012

(65) Prior Publication Data

US 2012/0246871 A1 Oct. 4, 2012

(30) Foreign Application Priority Data

Mar. 29, 2011 (JP) ..... 2011-071998

(51) Int. Cl.
*E05C 17/22* (2006.01)

(52) U.S. Cl.
USPC ..... 16/86 C; 16/86 B

(58) Field of Classification Search
USPC . 16/86 C, 85, 86 B, 86 A, 334, 332; 292/262, 292/265, 269, 273, 275, 278, DIG. 15; 296/146.4, 146.11, 146.12
See application file for complete search history.

(56) References Cited

U.S. PATENT DOCUMENTS

| | | | | |
|---|---|---|---|---|
| 6,842,943 | B2 * | 1/2005 | Hoffmann et al. | 16/82 |
| 7,143,473 | B2 * | 12/2006 | Matsuki | 16/86 C |
| 2003/0101537 | A1 * | 6/2003 | Matsuki et al. | 16/85 |
| 2006/0207059 | A1 * | 9/2006 | Van Den Heuvel | 16/86 B |
| 2008/0066260 | A1 * | 3/2008 | Clark | 16/86 A |
| 2009/0072552 | A1 * | 3/2009 | Kitayama et al. | 292/262 |

FOREIGN PATENT DOCUMENTS

| | | | |
|---|---|---|---|
| JP | 10169283 | A * | 6/1998 |
| JP | 3099226 | B2 | 8/2000 |
| JP | 2001246937 | A * | 9/2001 |
| JP | 2004-190431 | A | 7/2004 |
| JP | 2006307430 | A * | 11/2006 |
| JP | 2010116685 | A * | 5/2010 |

* cited by examiner

*Primary Examiner* — Chuck Mah
(74) *Attorney, Agent, or Firm* — Foley & Lardner LLP

(57) ABSTRACT

A door check link apparatus includes a check link formed by molding a synthetic resin on a surface of a core plate, and including a full open stopper including a projecting portion located at a tip end portion of the core plate, and having a width larger than a width of a detent surface, a bending piece formed at a first end portion of the projecting portion, and having a stopper surface confronting the stopper receiving surface, and a protruding portion formed on the projecting portion at a position farther apart from the stopper receiving surface relative to the stopper surface, and protruding in a direction substantially parallel to the stopper receiving surface, the full open stopper being formed by molding the synthetic resin on the tip end portion of the core plate including the projecting portion, the bending piece, and the protruding portion.

9 Claims, 13 Drawing Sheets

DOOR CHECK LINK APPARATUS FOR VEHICLE

BACKGROUND OF THE INVENTION

This invention relates to a door check link apparatus for a vehicle which is arranged to restrict a full open position of a door pivotally mounted to a body of the vehicle.

A Japanese Patent No. 3099226 discloses a door check link apparatus for a vehicle including a check link having a base end portion swingably connected to a body; and a check structure receiving a pair of upper and lower shoes which are mounted within a case mounted to the door, and which are slidably abutted, respectively, on detent surfaces of the check link in accordance with an open operation of the door. Both of the shoes are slidably abutted on both of the detent surfaces of the check link, and accordingly the door check link apparatus provides a predetermined check force to the open operation of the door. The door check link apparatus is arranged to restrict a full open position of the door by abutting the case of the check structure on a full open stopper provided at a tip end portion of the check link.

SUMMARY OF THE INVENTION

However, in the above-described door check link apparatus for the vehicle, protruding portions are formed by bending, in directions crossing a longitudinal direction of a core plate, a projecting portion provided at the end portion of the core plate which is made of the metal, and which constitutes the check link. The full open stopper formed into a block shape is formed by molding (coating) the synthetic resin on this protruding portions. Inner end surfaces of the protruding portions are abutment portions which are arranged to be abutted on the case. Accordingly, when the case of the check structure is abutted on the full open stopper in the full open state of the door and the case and the full open stopper become a one-side abutting state (in which the case of the check structure is abutted obliquely on the stopper surface of the full open stopper), the load is concentrated locally on one of the protruding portions on which the case is abutted in the one-side abutting state. Accordingly, the synthetic resin may be cracked, and the synthetic resin may be peeled off from the projecting portion of the core plate.

It is, therefore, an object of the present invention to provide a door check link apparatus for a vehicle to be devised to solve the above mentioned problem, and to suppress peeling-off of synthetic resin from a core plate constituting a check link.

According to one aspect of the present invention, a door check link apparatus for a vehicle, the door check link apparatus comprises: a case fixed to one of a door and a body of the vehicle; a check link having a base end portion swingably connected to the other of the door and the body; and a shoe which is received within the case, and which is slidably abutted on a detent surface of the check link, the check link which is formed by molding a synthetic resin on a surface of a core plate made from a metal, and which includes the detent surface having a raised portion and a recessed portion that are located at a substantially central portion of a longitudinal direction, and that are formed in the longitudinal direction, and a full open stopper that is located at a tip end portion, and which is arranged to be abutted on a stopper receiving surface of the case, and thereby to restrict a full open position of the door, the check link being constituted by integrally forming the detent surface and the full open stopper, the full open stopper of the check link including a projecting portion which is located at a tip end portion of the core plate, and which has a width larger than a width of the detent surface, a bending piece which is formed at a first end portion of the projecting portion that is near the stopper receiving surface of the case, and which has a stopper surface confronting the stopper receiving surface, and a protruding portion which is formed on the projecting portion at a position farther apart from the stopper receiving surface relative to the stopper surface of the bending piece, and which protrudes in a direction substantially parallel to the stopper receiving surface, the full open stopper being formed by molding the synthetic resin on the tip end portion of the core plate including the projecting portion, the bending piece, and the protruding portion.

BRIEF DESCRIPTION OF THE DRAWINGS

FIG. 14A is a perspective view showing a full open stopper. FIG. 14B is a plan view showing the full open stopper. FIG. 14C is a view showing the full open stopper as viewed from an arrow c in FIG. 14B. FIG. 14D is a view showing the full open stopper as viewed from an arrow d in FIG. 14C.

FIG. 15A is a perspective view showing a full open stopper. FIG. 15B is a plan view showing the full open stopper. FIG. 15C is a view showing the full open stopper as viewed from an arrow c in FIG. 15B. FIG. 15D is a view showing the full open stopper as viewed from an arrow d in FIG. 15C.

FIG. 16A is a perspective view showing a full open stopper. FIG. 16B is a plan view showing the full open stopper. FIG. 16C is a view showing the full open stopper as viewed from an arrow c in FIG. 16B. FIG. 16D is a view showing the full open stopper as viewed from an arrow d in FIG. 16C.

FIG. 17A is a perspective view showing a full open stopper. FIG. 17B is a plan view showing the full open stopper. FIG. 17C is a view showing the full open stopper as viewed from an arrow c in FIG. 17B. FIG. 17D is a view showing the full open stopper as viewed from an arrow d in FIG. 17C.

DETAILED DESCRIPTION OF THE INVENTION

Hereinafter, embodiments according to the present invention are illustrated with reference to the drawings. A downward direction in FIG. 2 corresponds to a forward direction. An upward direction in FIG. 2 corresponds to a rearward direction. A leftward direction and a rightward direction in FIG. 2 correspond, respectively, to a leftward direction and a rightward direction.

Figure 1:
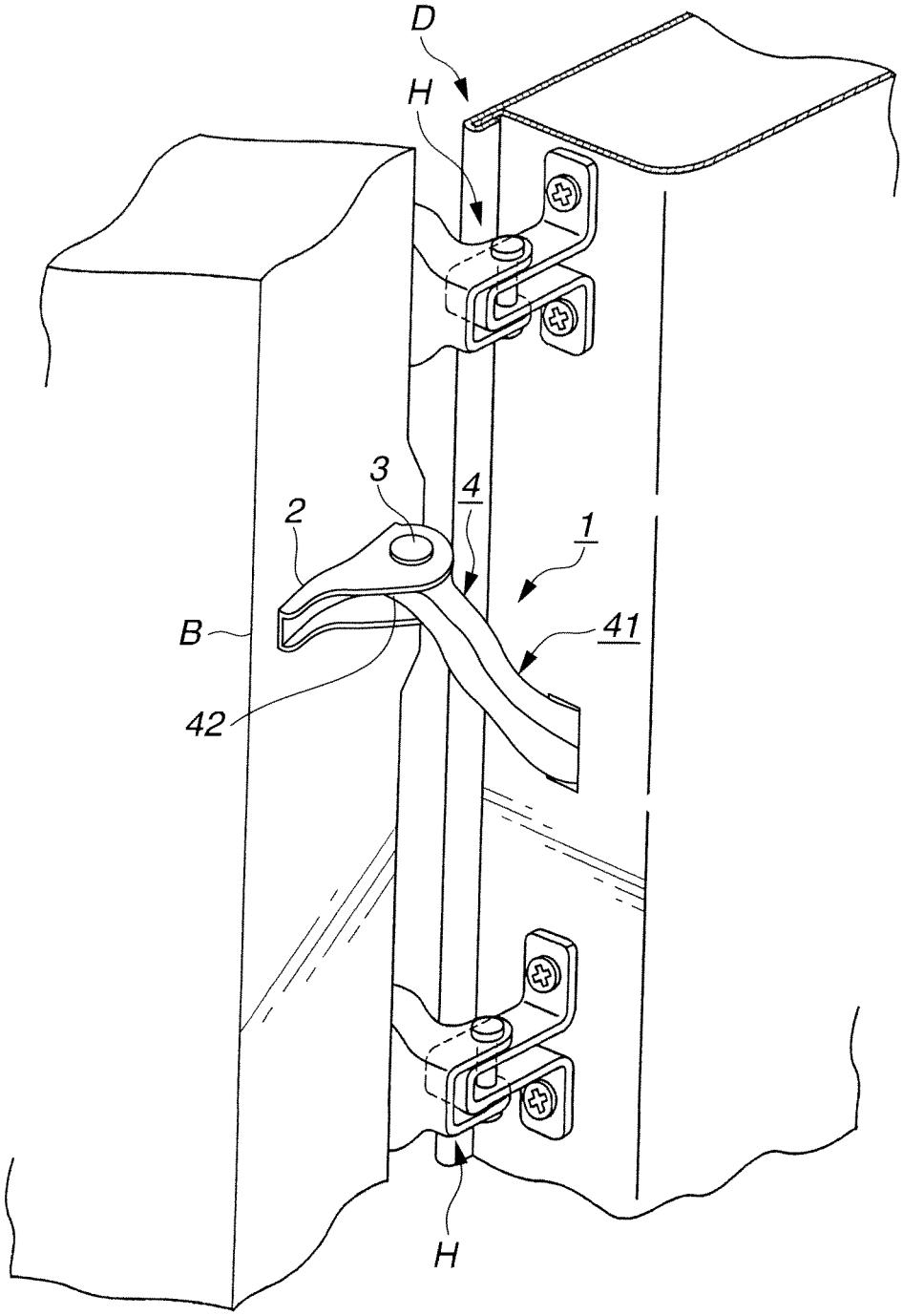
FIG. 1 is a perspective view showing a main part of a vehicle to which a door check link apparatus according to embodiments of the present invention is mounted.
Figure 2:
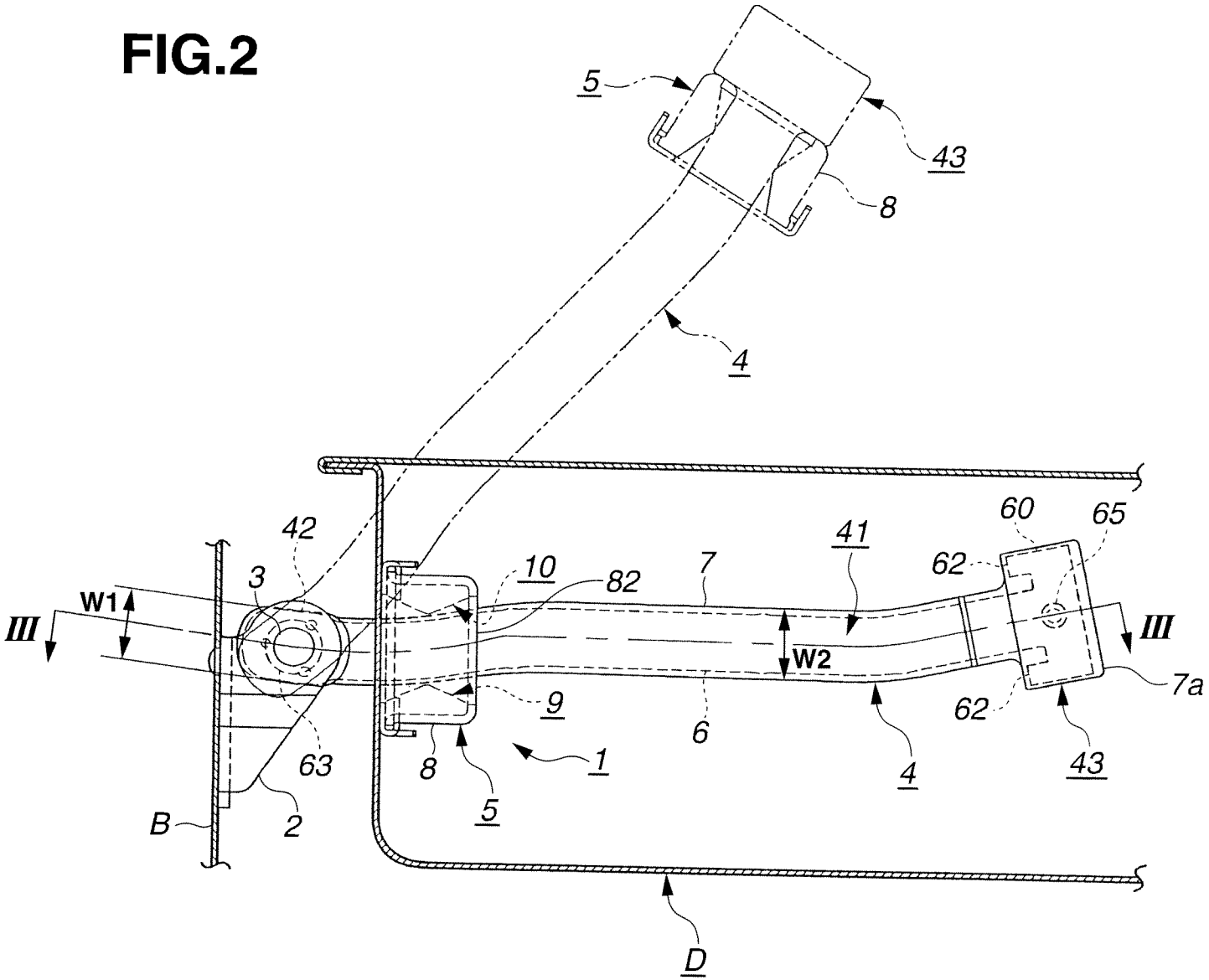
FIG. 2 is a plan view showing the door check link apparatus of FIG. 1.

A door check link apparatus 1 is arranged to provide a check force to open/close operation of a door pivotally mounted to a body B of the vehicle by a pair of upper and lower hinges H each having a hinge shaft extending in the upward and downward directions, and thereby to hold the door D at a half open position or to restrict the door D at a full open position. As shown in FIGS. 1 and 2, the door check link apparatus 1 includes a check link 4 having a base end portion (a lower end portion in FIGS. 2-4 and 6) pivotally mounted to a fix bracket 2 fixed to the body B by a pivot shaft 3 extending in the upward and downward directions, so as to swing the check link 4 in the leftward and rightward directions, and a tip end portion (on an upper side in FIGS. 2-4 and 6) arranged to enter the door D; and a check structure 5 mounted within the door D.

When the door D is moved from a closed position in an open direction, the check structure 5 is moved from a position shown by a solid line in FIG. 2 toward the tip end portion of the check link 4 (on the upper side in FIG. 2). With this, a rear surface of a case 8 of the check structure 5, that is, a stopper receiving surface 82 is abutted on a full open stopper 43 provided at the tip end portion of the check link 4, so that the full open position of the door D is restricted.

The check link 4 is formed by molding synthetic resin 7 on an entire surface of a core plate (base plate) 6 made of metal.

The core plate 6 includes a shaft hole 61 which is located at a base end portion (a lower portion in FIGS. 2-4, and 6) of the core plate 6, and into which the pivot shaft 3 is inserted; and a projecting portion (flared portion) 60, a bending piece 62, and a protruding portion 65 which are located at a tip end portion (an upper portion in FIGS. 2-4, and 6) of the core plate 6, and which constitute the full open stopper 43. The projecting portion 60, the bending piece 62, and the protruding portion 65 are integrally formed by bending, or burring. The shaft hole 61 is formed by the burring. The core plate 6 further includes a cylindrical protruding portion 63 which is formed around the shaft hole 61, and which protrudes in the upward direction. Entire circumferences of the projecting portion 60, the bending piece 62, and the protruding portion 65 of the full open stopper 43 are molded with a synthetic resin stopper portion 7*a* of the synthetic resin 7.

The synthetic resin 7 includes upper and lower detent surfaces 41 each including raised portions 411 and recessed portions 412 which are formed by molding on the entire surface of the core plate 6, and which are alternately formed in the longitudinal direction (in the upward and downward directions in FIGS. 2-4, and 6) of the core plate 6. Moreover, the synthetic resin 7 includes a boss portion 42 which is formed at the base end portion of the core plate 6, and which is pivotally mounted through the pivot shaft 3 to the fix bracket 2; and the full open stopper 43 arranged to restrict the full open position of the door D, and formed, at the tip end portion of the core plate 6, by molding the synthetic resin stopper portion 7*a* which is a part of the synthetic resin 7, on the entire circumferences of the projecting portion 60, the bending piece 62, and the protruding portion 65.

Figure 13:
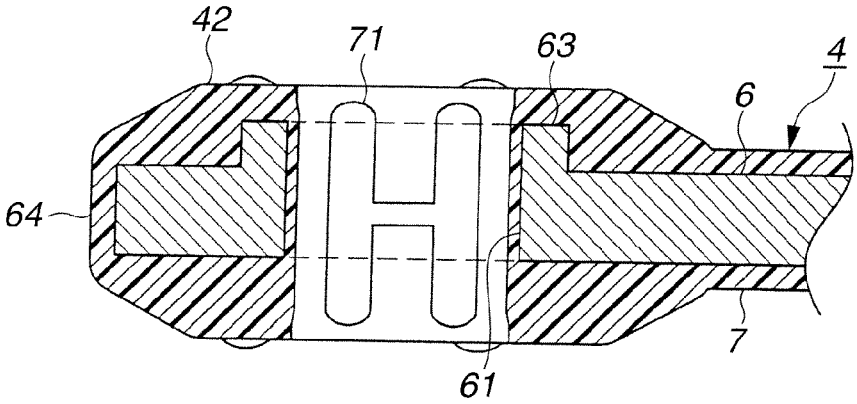
FIG. 13 is an enlarged longitudinal sectional view showing the boss portion of the check link.

The boss portion 42 of the check link 4 is formed by molding the synthetic resin 7 on an inner circumference surface of the shaft hole 61 of the core plate 6 and an outer circumference of the cylindrical protruding portion 63. The boss portion 42 of the check link 4 has a width W1 (cf. FIG. 2) substantially identical to a width W2 (cf. FIG. 2) of the detent surface 41. The boss portion 42 of the check link 4 has a thickness H1 (cf. FIG. 6) in the axial direction of the pivot shaft 3 which is substantially identical to a thickness H2 (cf. FIG. 6) of the raised portion 411 in the detent surface 41. In this way, the boss portion 42 is formed by molding on the cylindrical protruding portion 63 formed around the shaft hole 61. Accordingly, it is possible to improve the strength of the boss portion 42 without increasing the width W1 of the boss portion 42 relative to the width W2 of the detent surface 41. Moreover, as shown in FIG. 13, there are formed a plurality of protrusions 71 which are formed on the inner circumference surface of the shaft hole 61 of the core plate 6, which are formed by the synthetic resin 7 along the circumferential direction, and which slightly protrude in the inside direction in a substantially H-shape. With this, it is possible to smoothly swing the boss portion 42 around the pivot shaft 3.

At the tip end of the boss portion 42 of the check link 4, there is formed a taper portion 64 which has a tapered shape for readily inserting the boss portion 42 between shoes 9 and 10 (described later).

The full open stopper 43 of the check link 4 is formed by molding the synthetic resin 7 on the projecting portion 60, the bending pieces 62, and the protruding portion 65 of the core plate 6 so that the full open stopper 43 is integrally formed with the check link 4 so as not to be separated from the check link 4. The full open stopper 43 of the check link 4 has a width greater than the width W2 of the detent surface 41, and the thickness in the upward and downward directions which is greater than the thickness H2 of the detent surface 41.

In case of restricting the door D at the full open position, the stopper receiving surface 82 of the case 8 of the check structure 5 is abutted on the synthetic resin stopper portion 7*a* of the full open stopper 43.

The check structure 5 is fixed to the inside of the door D by bolts (not shown) extending in the forward and rearward directions. The check structure 5 includes the above-mentioned case 8 including through holes 81 and 81 through which the check link 4 penetrates in the forward and rearward directions; a pair of the upper and lower shoes 9 and 10 which are received within the case 8, and which are arranged to be slidably abutted, respectively, on the detent surfaces 41 and 41 of the check link 4; and upper and lower elastic members 11 and 11 which are made of rubber, which are received within the case 8, and which are arranged to urge shoes 9 and 10 toward the detent surfaces 41 and 41. Besides, the elastic members 11 may be coil springs, in place of the rubbers.

Figure 9:
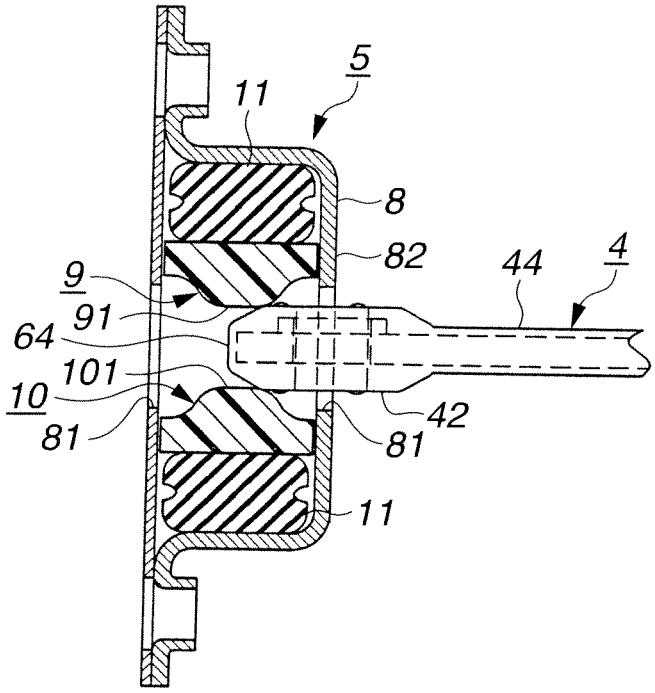
FIG. 9 is an enlarged longitudinal sectional view showing a main part when a boss portion of the check link is inserted between the both shoes.

As shown in FIG. 9, when the check link 4 is mounted to the check structure 5, the taper portion 64 of the boss portion 42 of the check link 4 is inserted through the through hole 81 of the case 8 of the check structure 5 between the upper and lower shoes 9 and 10 so that both of the shoes 9 and 10 are moved in a direction to be apart from each other against the urging force of the upper and lower elastic members 11 so as to pass through the interspace between both the shoes 9 and 10. Then, the check structure 5 is moved to a flat portion 44 which is between the boss portion 42 and the detent surfaces 41 of the check link 4, and which has a small thickness.

Figure 8:
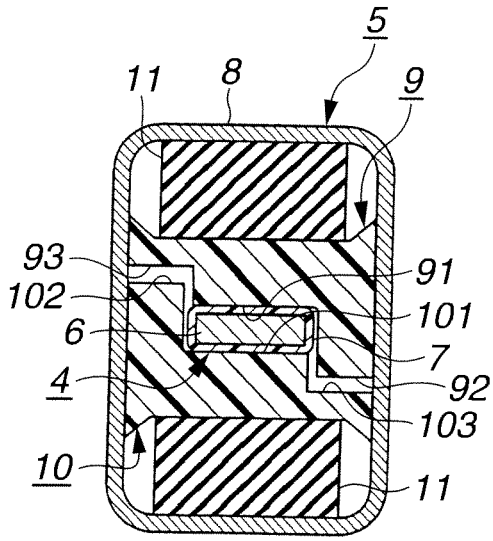
FIG. 8 is a longitudinal sectional view taken along a section line VIII-VIII of FIG. 3.
Figure 11:
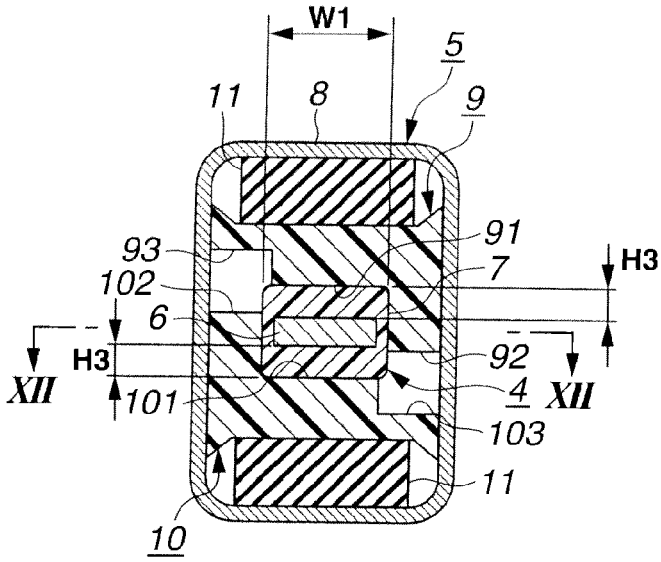
FIG. 11 is a longitudinal sectional view taken along a section line XI-XI of FIG. 10.
Figure 12:
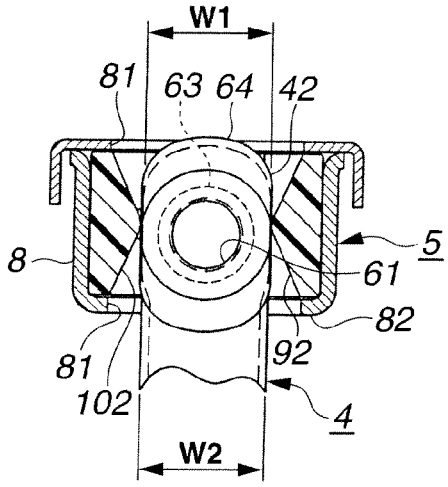
FIG. 12 is a transverse sectional view taken along a section line XII-XII of FIG. 11.

As shown in FIGS. 8 and 11, the both of the shoes 9 and 10 are disposed symmetrical with respect to a point in a state in which the shoes 9 and 10 sandwich the check link 4 from the upward and downward directions.

As shown in FIGS. 8 and 11, the upper shoe 9 includes a slidably abutting portion 91 slidably abutted on the upper detent surface 41 of the check link 4; a guide wall 92 which is located on a right side of the slidably abutting portion 91, which protrudes in the downward direction, and which is slidably abutted on a right side surface of the check link 4 in the widthwise direction; and a stepped portion 93 which is located on a left side (a portion apart from the width of the check link 4 in the leftward direction) of the slidably abutting portion 91, which is recessed in a direction (in the upward direction) farther apart from the lower shoe 10 relative to a surface of the slidably abutting portion 91, and which confronts an upper end surface of a guide wall 102 of the lower shoe 10. An outer side surface (right side surface) of the guide wall 92 is slidably abutted on an inner side surface of the case 8. An outer side surface (left side surface) of the stepped portion 93 is slidably abutted on an inner side surface of the case 8. With this, when the upper shoe 9 is moved in the upward and downward directions, the upper shoe 9 is not inclined within the case 8, and the upper shoe 9 can be surely moved in the upward and downward directions.

As shown in FIGS. 8 and 11, the lower shoe 10 includes a slidably abutting portion 101 slidably abutted on the lower detent surface 41 of the check link 4; the guide wall 102 which is located on a left side of the slidably abutting portion 101, which protrudes in the upward direction, and which is slidably abutted on a left side surface of the check link 4 in the widthwise direction, and a stepped portion 103 which is located on a right side of the slidably abutting portion 101, which is recessed in a direction to be farther apart from the upper shoe 9 relative to the slidably abutting portion 101, and which confronts a lower end surface of the guide wall 92 of the upper shoe 9. An outer side surface (left side surface) of the guide wall 102 is slidably abutted on the inner side surface of the case 8. An outer side surface (right side surface) of the stepped portion 103 is slidably abutted on the inner side surface of the case 8. With this, the lower shoe 10 is not inclined within the case 8, and the lower shoe 10 can be surely moved in the upward and downward directions.

Figure 10:
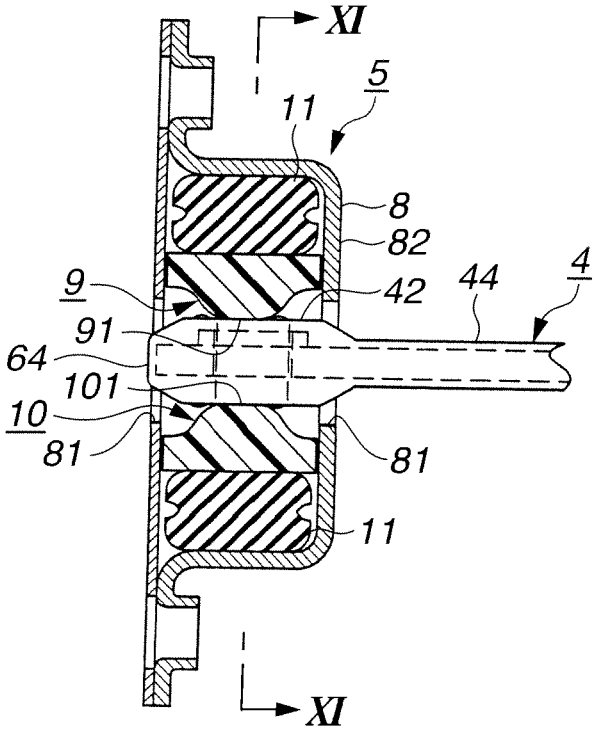
FIG. 10 is an enlarged longitudinal sectional view showing a main part when the boss portion of the check link passes through between the both shoes.

As shown in FIGS. 9 and 10, the slidably abutting portions 91 and 101 of the shoes 9 and 10 are formed in raised shape which are raised toward the surfaces of the check link 4. With this, when the boss portion 42 of the check link 4 is inserted between the shoes 9 and 10, the taper portion 64 of the boss portion 42 can be readily inserted between the slidably abutting portions 91 and 101 of the shoes 9 and 10.

The elastic members 11 are disposed, respectively, between the back surfaces of the shoes 9 and 10 and the upper and lower inner surfaces of the case 8, so as to urge the shoes 9 and 10 to both of the detent surfaces 41 and 41 of the check link 4.

Figure 3:
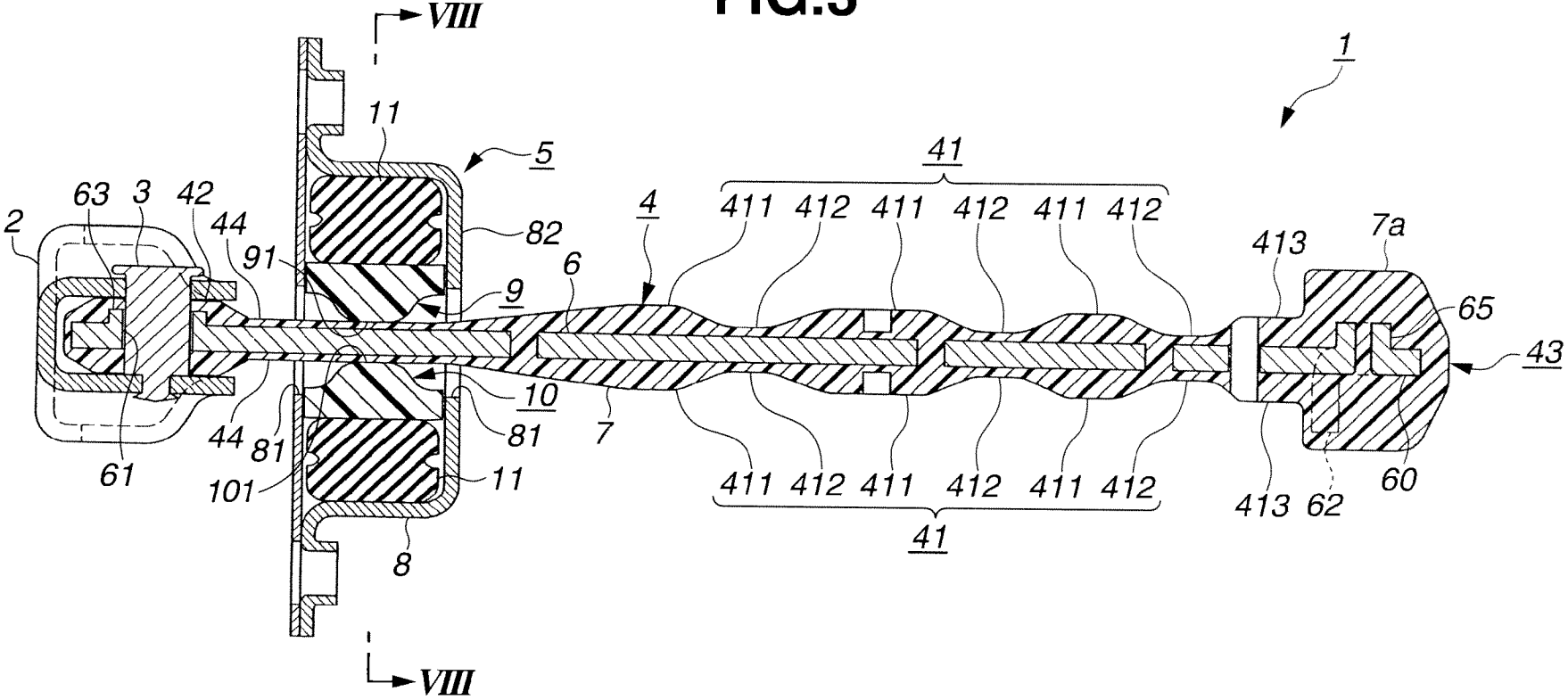
FIG. 3 is a longitudinal sectional view taken along a section line of FIG. 2.
Figure 4:
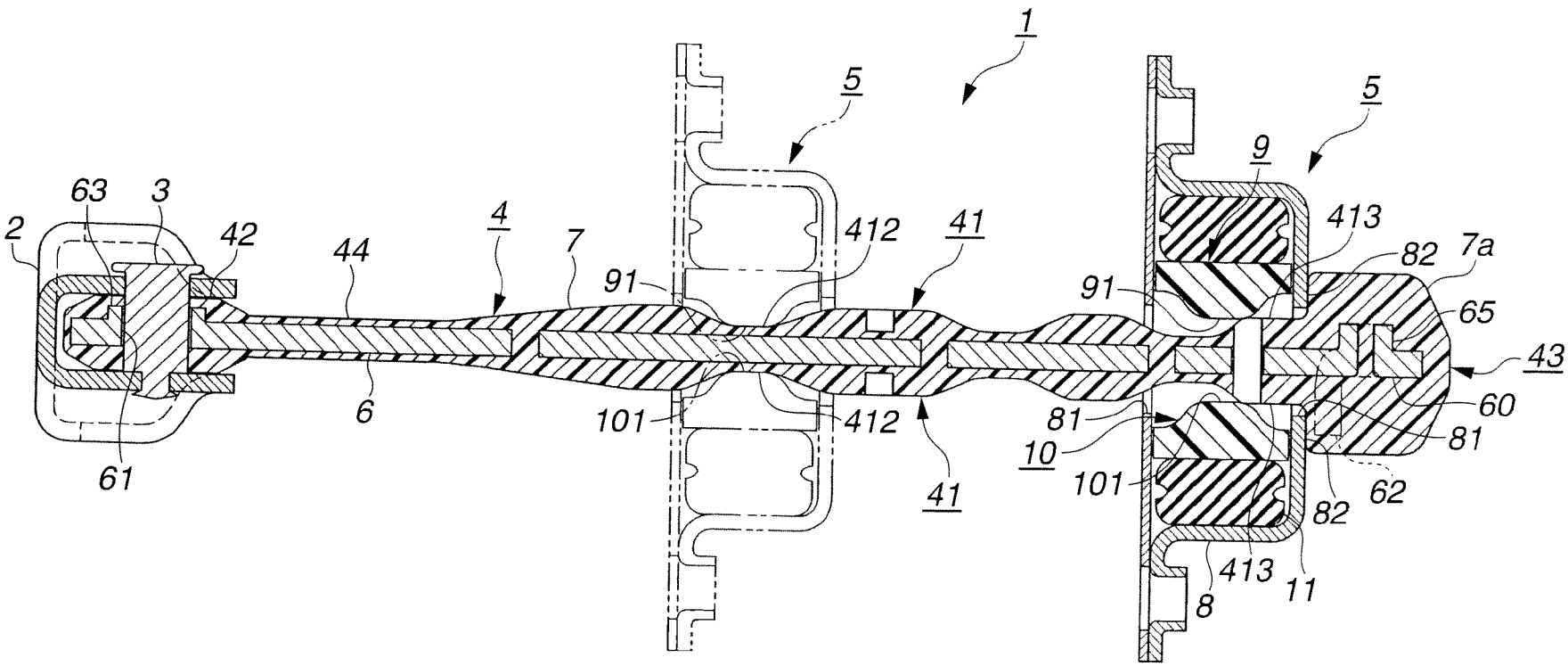
FIG. 4 is a longitudinal sectional view showing the door check link apparatus at a full open position of a door.
Figure 5:
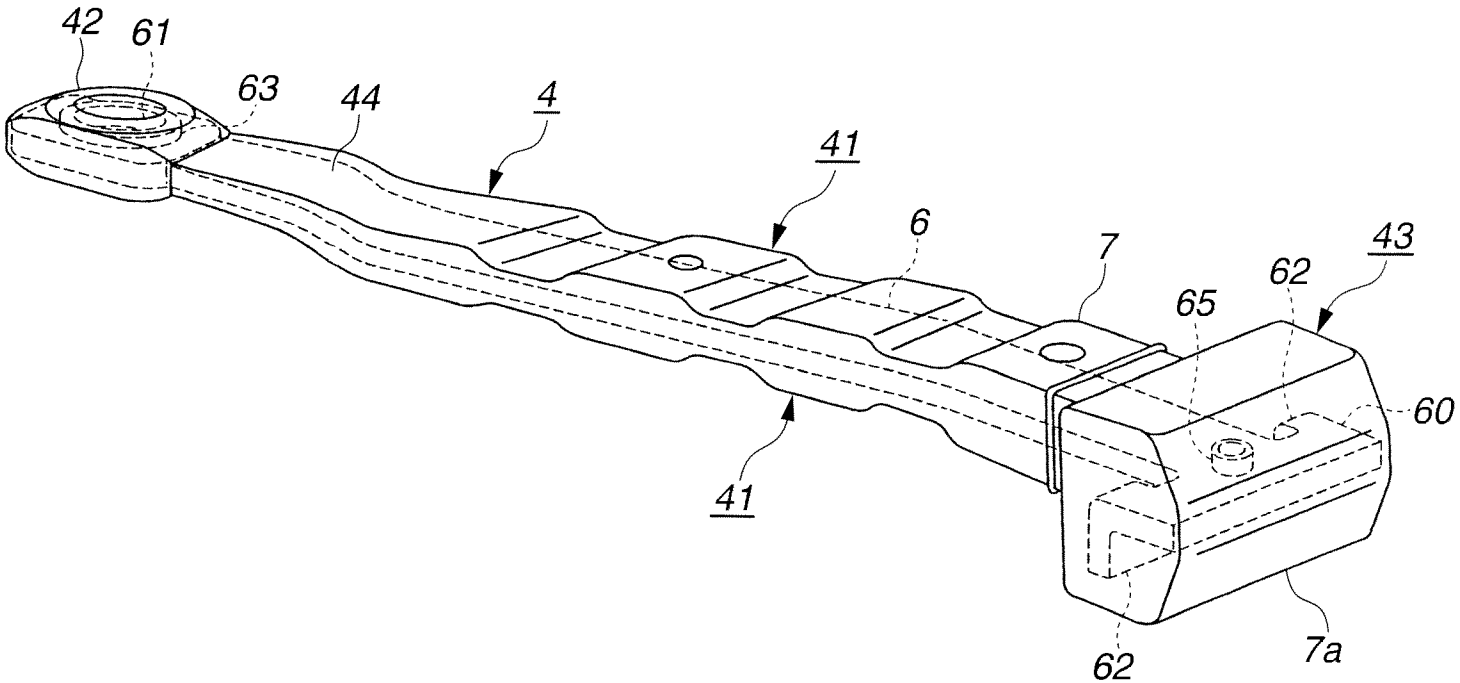
FIG. 5 is a perspective view showing the check link.
Figure 6:
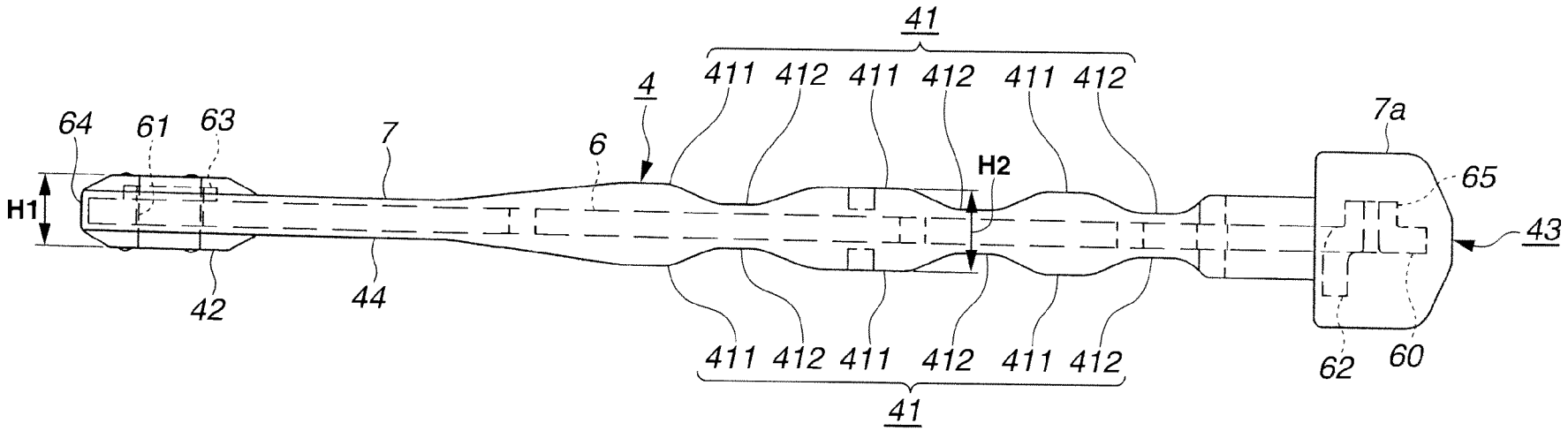
FIG. 6 is a side view showing the check link.
Figure 7:
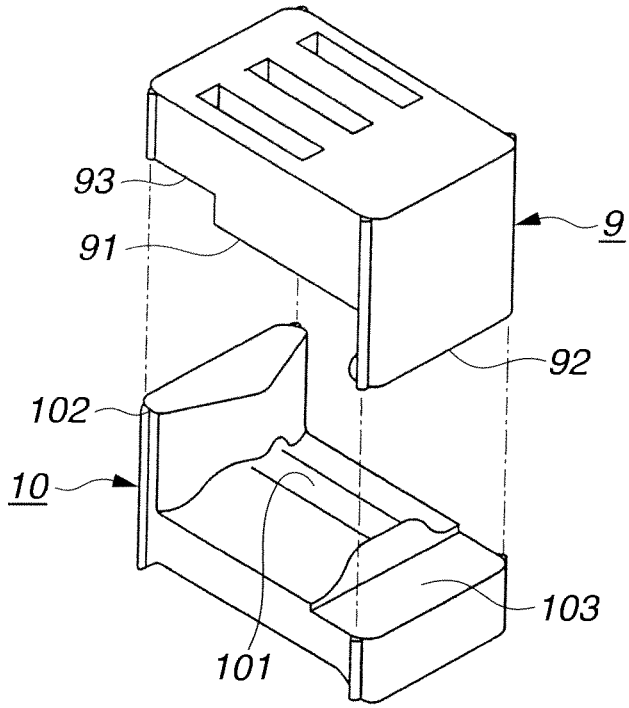
FIG. 7 is an enlarged perspective view showing both shoes.

When the shoes 9 and 10 are positioned at positions corresponding to the closed position of the door D as shown in FIG. 3, the shoes 9 and 10 sandwich the flat portion 44 of the check link 4 from the upward and downward directions. When the shoes 9 and 10 are positioned at positions corresponding to the half open position of the door D as shown by two-dot chain line of FIG. 4, the slidably abutting portions 91 and 101 are fit on the recessed portions 412 of the detent surfaces 41. Accordingly, the door D is held at the half open position by a predetermined check force. Moreover, when the shoes 9 and 10 are positioned at positions corresponding to the full open position as shown by a solid line of FIG. 4, the slidably abutting portion 91 and 101 run on a raised portion 413 connected with the full open stopper 43.

Protruding amounts of the guide walls 92 and 102 of the shoes 9 and 10 in the upward and downward directions are set as follows.

(1) As shown in FIG. 11, the guide walls 92 and 102 of the shoes 9 and 10 are set larger than a thickness H3 of each of the upper and lower surfaces of the synthetic resin 7 of the boss portion 42. With this, when the check link 4 passes from the boss portion 42 between the shoes 9 and 10 at the assembly operation of the check link 4 to the check structure 5, abutment amounts (lengths) between the guide walls 92 and 102 of the shoes 9 and 10 and the side surfaces of the boss portion 42 of the check link 4 (a range in which the inner side surfaces of the guide walls 92 and 102 are abutted on the side surfaces of the boss portion 42 of the check link 4) is increased in the upward and downward directions, relative to the conventional apparatus. A gap between the tip end surface of the guide wall 92 and the slidably abutting portion 101, and a gap between the tip end surface of the guide wall 102 and the slidably abutting portion 91 are decreased respectively, so that the insertion direction of the boss portion 42 is restricted, with the reason that the width W1 of the boss portion 42 of the check link 4 is substantially identical to the width W2 of the detent surface 41. Accordingly, it is possible to surely insert the boss portion 42 of the check link 4 between the slidably abutting portions 91 and 101 of both of the shoes 9 and 10, and between the guide walls 92 and 102 of both of the shoes 9 and 10, and thereby to decrease the assembly man-hour.

Moreover, the protruding amounts of the guide walls 92 and 102 in the upward and downward directions are greater than the thickness H3 of the synthetic resin 7 of the boss portion 42 in the upward and downward directions. Accordingly, even when the large force in the lateral direction is acted to the check link 4 and the side surfaces of the check link 4 are tightly pressed against the guide walls 92 and 102 of the shoes 9 and 10, the synthetic resin 7 is not peeled off from the upper and lower surfaces of the core plate 6.

(2) When both of the shoes 9 and 10 are positioned at positions corresponding to the closed position of the door D as shown in FIG. 3, that is, when both of the shoes 9 and 10 are positioned in the flat portion 44 of the check link 4, the guide wall 92 of the upper shoe 9 can be slidably abutted on the right side surface of the flat portion 44 of the check link 4 in a state in which the lower end surface of the guide wall 92 of the upper shoe 9 protrudes downwardly beyond the lower surface 44 of the check link 4 to enter the stepped portion 103 of the lower shoe 10, as shown in FIG. 8. Moreover, the guide wall 102 of the lower shoe 10 can be slidably abutted on the left side surface of the flat portion 44 of the check link 4 in a state in which the upper side surface of the guide groove 102 of the lower shoe 10 protrudes upwardly beyond the upper surface of the flat portion 44 of the check link 4 to enter the stepped portion 93 of the upper shoe 9. With this, even when the protruding amounts of the guiding walls 92 and 102 of the shoes 9 and 10 are increased, both of the shoes 9 and 10 do not interfere with each other, and it is possible to suppress the backlash of the check link 4 in the widthwise direction. Moreover, in the upper shoe 9, the outer side surface (right side surface) of the guide wall 92 is slidably abutted on the inner side surface of the case 8, and the outer side surface (left side surface) of the stepped portion 93 is slidably abutted on the inner side surface of the case 8. With this, it is possible to suppress the inclination of the upper shoe 9 within the case 8. In the lower shoe 10, the outer side surface (left side surface) of the guide wall 102 is slidably abutted on the inner side surface of the case 8, the outer side surface (right side surface)

of the stepped portion 103 is slidalby abutted on the inner side surface of the case 8. Accordingly, it is possible to suppress the inclination of the lower shoe 10 within the case 8. With this, when the door D is at the closed position, the slidably abutting surfaces 91 and 101 of both of the shoes 9 and 10 can surely sandwich the upper and lower surfaces of the check link 4. Accordingly, it is possible to surely suppress the backlash of the check link 4 when the vehicle runs.

First Embodiment

The full open stopper 43 according to the first embodiment is applied to the above-described embodiments. As shown in FIGS. 14A-14D, the full open stopper 43 includes the projecting portion 60 which is located at the tip end portion of the core plate 6, and which has a width larger than the width W2 of the detent surface 41; the pair of the left and right bending pieces 62 which are formed by bending, in the downward direction (the direction parallel to the stopper receiving surface 82), both sides of the front side of the projecting portion 60, that is, a side of the projecting portion 60 which is near the stopper receiving surface 82 of the case 8 (the left side in the FIGS. 14B and 14C); and the protruding portion 65 which is formed on the upper surface of the projecting portion 60 (on a surface which is opposite to the bending direction of the bending piece 62, and which is perpendicular to the bending direction of the bending piece 62), and which protrudes in the cylindrical shape. The full open stopper 43 is formed by molding the synthetic resin stopper portion 7*a* which is a part of the synthetic resin 7, on the tip end portion of the core plate 6 including the projecting portion 60, both the bending pieces 62, and the protruding portion 65 so that the full open stopper 43 is formed into a block shape.

Figure 14A:
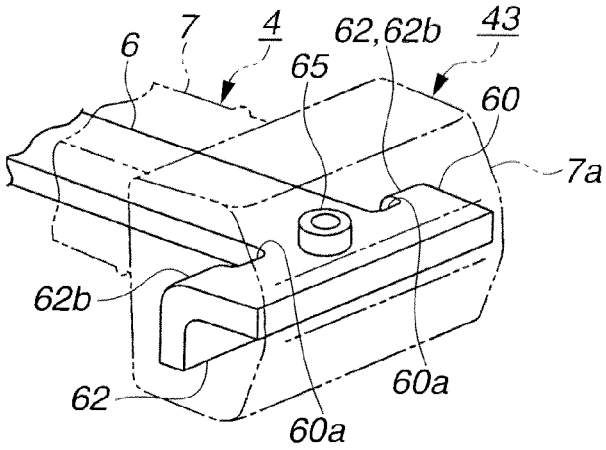
FIGS. 14A-14D are views showing a door check link apparatus according to a first embodiment of the present invention.
Figure 14B:
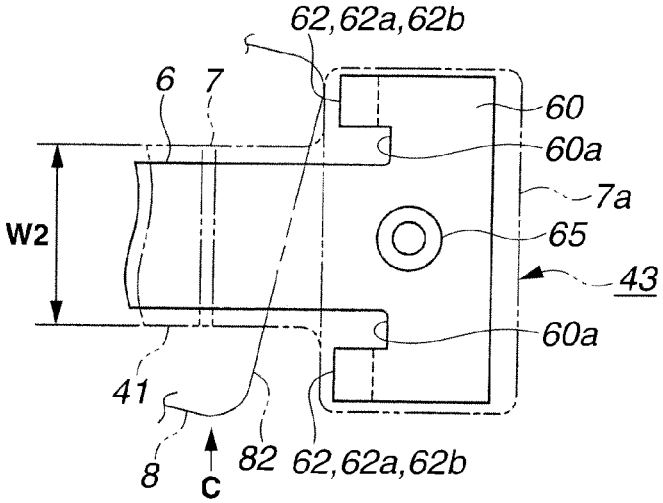
Figure 14C:
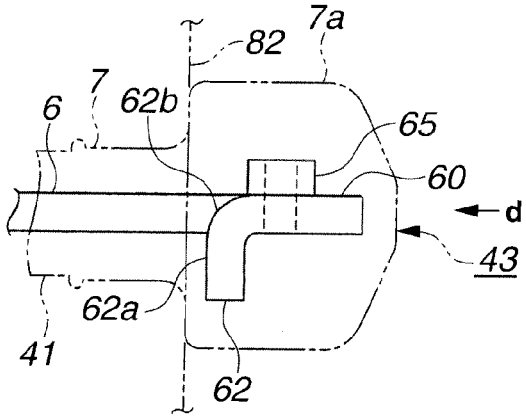
Figure 14D:
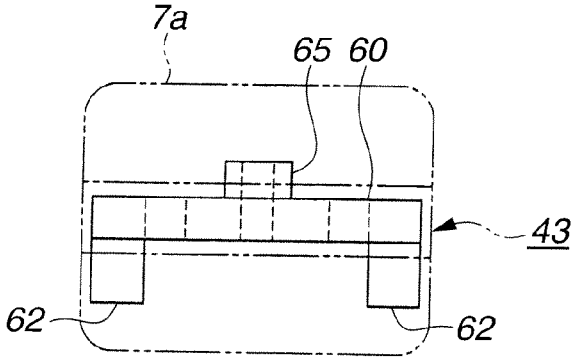
Figure 15A:
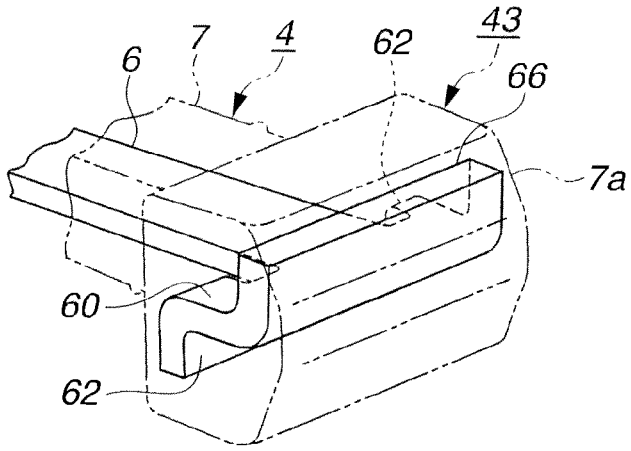
FIGS. 15A-15D are views showing a door check link apparatus according to a second embodiment of the present invention.
Figure 15B:
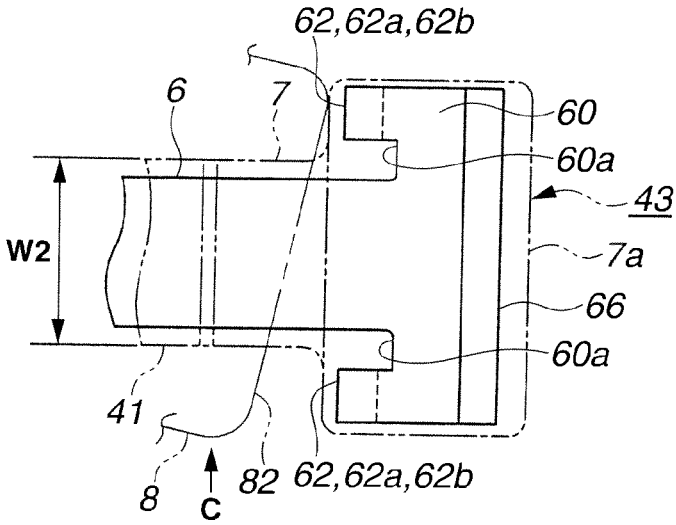
Figure 15C:
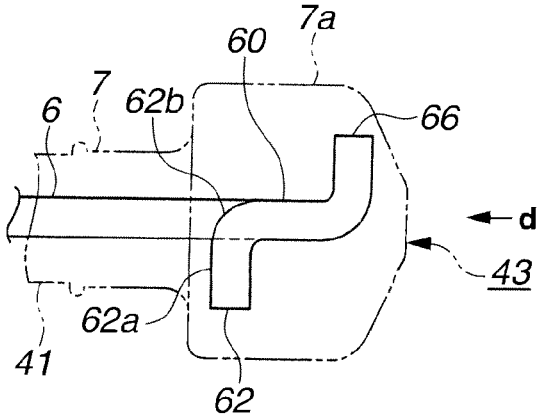
Figure 15D:
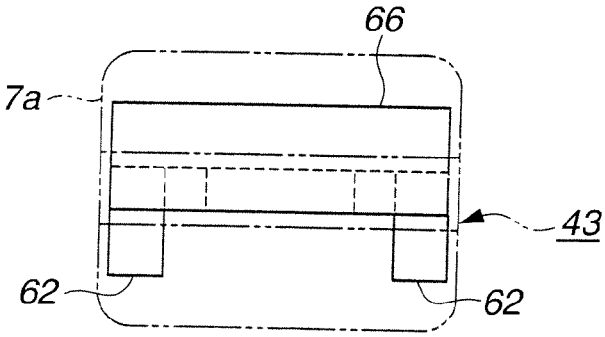
Figure 16A:
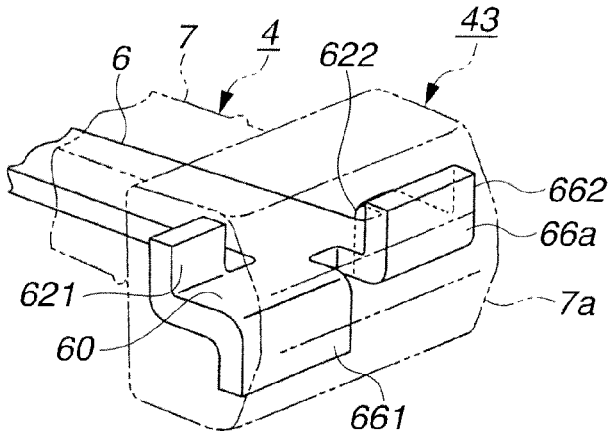
FIGS. 16A-16D are views showing a door check link apparatus according to a third embodiment of the present invention.
Figure 16B:
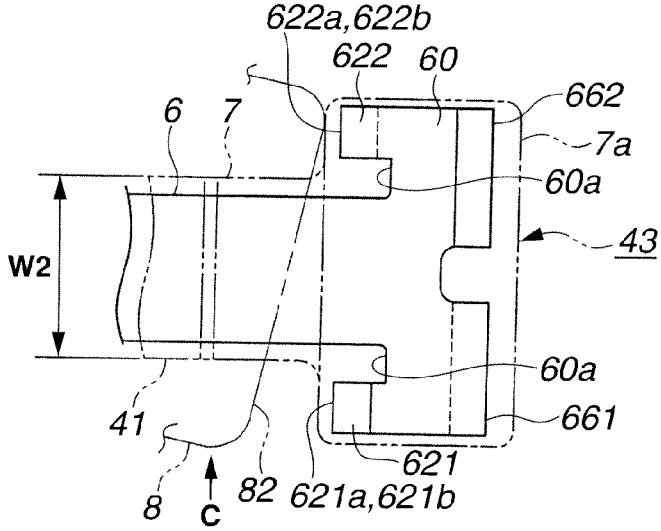
Figure 16C:
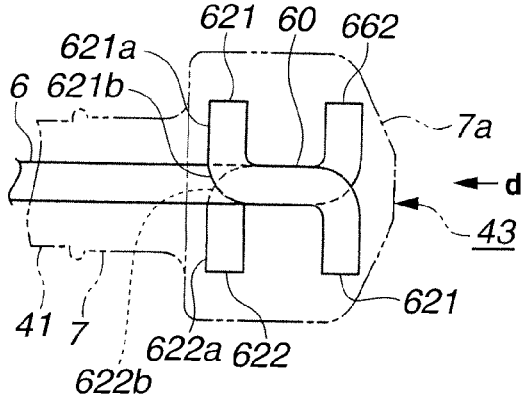
Figure 16D:
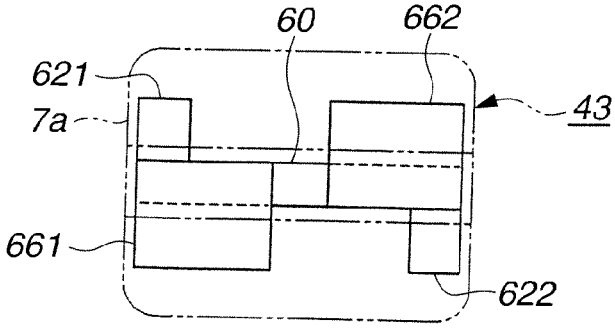
Figure 17A:
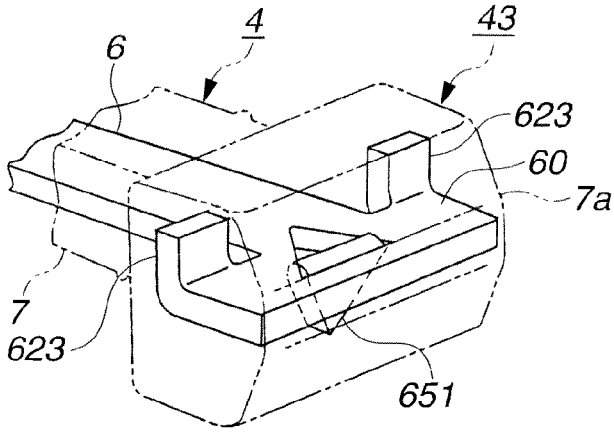
FIGS. 17A-17D are views showing a door check link apparatus according to a fourth embodiment of the present invention.
Figure 17B:
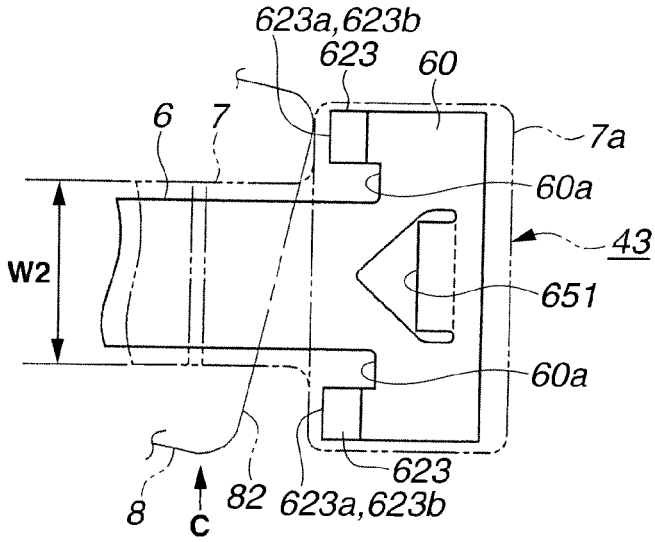
Figure 17C:
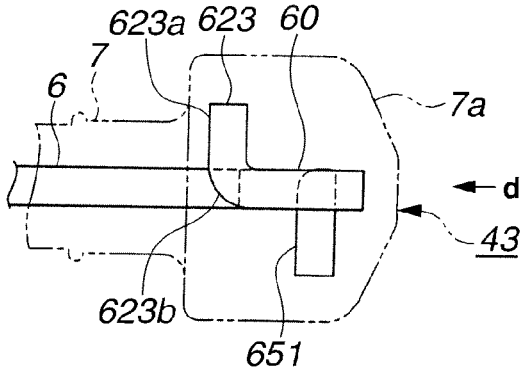
Figure 17D:
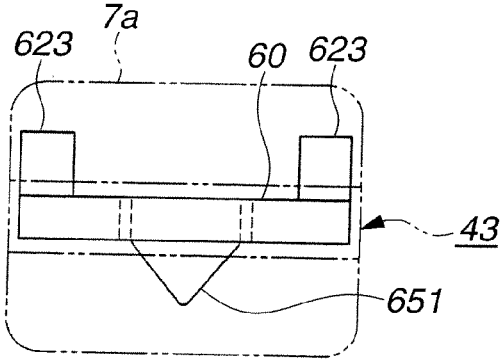

As shown in FIG. 14B, both of the bending pieces 62 is formed by bending the left and right side portions of the front portion (the portion confronting the stopper receiving portion 82) of the projecting portion 60 so as to position on both sides of the widthwise direction of the check link 4. With this, the outer bending portions 62*b* of the bending pieces 62 (each of which connects the stopper surface 62*a* and the upper surface of the projecting portion 60) protrude in the forward direction relative to the front end 60*a* of the projecting portion 60. Each of the stopper surfaces 62*a* of the bending piece 62 confronts parallel to the stopper receiving surface 82. Each of the stopper surfaces 62*a* of the bending pieces 62 is arranged to be abutted on the stopper receiving surface 82 through the synthetic resin stopper portion 7*a*.

The protruding portion 65 is located on the upper surface of the projecting portion 60. The protruding portion 65 is formed between both of the bending pieces 62 and 62 at a position rearward of both of the bending pieces 62 (at a position farther apart from the stopper receiving surface 82 relative to the stopper surfaces 62*a* of both of bending pieces 62). The synthetic resin 7 is molded within the cylindrical protruding portion 65. With this, the synthetic resin stopper portion 7*a* molded on the upper surface and the lower surface of the projecting portion 60 is connected by the synthetic resin 7 within the protruding portion 65. With this, the synthetic resin stopper portion 7*a* molded on the projecting portion 60 is difficult to peel off from the surface of the projecting portion 60.

When the door D is opened, the stopper receiving surface 82 of the case 8 is abutted on the stopper surfaces 62*a* of both of the bending pieces 62 through the synthetic resin stopper portion 7*a*, so that the full open position of the door D is restricted. In this case, as shown in FIG. 14B, when the stopper receiving surface 82 of the case 8 is abutted on the full open stopper 43 in one-side abutting state (in which the stopper receiving surface 82 is obliquely abutted on the full open stopper 43 so that one side of the stopper receiving portion 82 is abutted on the full open stopper 43) by the error of the assembly and so on, the load is acted to the stopper surface 62*a* of one of both of the bending pieces 62 (the upper bending piece 62 in the FIG. 14B), and the protruding portion 65 through the synthetic resin stopper 7*a*.

However, in the first embodiment, even when the stopper receiving surface 82 of the case 8 and the full open stopper 43 are in the one-side abutting state when the door D is restricted to the full open position, the load is received by the wide stopper surfaces 62*a* of the bending pieces 62.

With this, the concentration of the load is decreased, and it is possible to suppress the cracking and the peeling-off of the synthetic resin stopper portion 7*a*. Moreover, the outer bending portions 62*b* of the bending pieces 62 confront the stopper receiving surface 82 of the case 8. Accordingly, the load acted to the bending pieces 62 is the compressive load. Consequently, it is possible to suppress the deformation of the bending pieces 62, and to improve the strength of the full open stopper 43. Moreover, the deformation of the synthetic resin stopper portion 7*a* on the upper surface side of the projecting portion 60 is prevented by the protruding portion 65 which is located on the surface opposite to the bending direction of the bending piece 62 at the position rearward of the stopper surfaces 62*a* of both of the bending pieces 62, and which protrudes in the cylindrical shape. As shown in FIG. 14B, the concentration of the load can be received by the two surfaces of the cylindrical outer surface and the lower surface of the protruding portion 65. Moreover, the area for receiving the concentration of the load is not varied for the cylindrical shape of the protruding portion 65 even either in the one-side abutting state and in the both-side abutting state. Furthermore, the part of the synthetic resin stopper portion 7*a* is sandwiched by the hole of the protruding portion 65 formed between the bending pieces 62 and 62 at the position rearward of both of the bending pieces 62 and 62, and the stopper surface 62*a* of the upper bending piece 62. With this, it is possible to suppress the position deviation of the synthetic resin stopper portion 7*a* with respect to the projecting portion 60, and to surely suppress the peeling-off of the synthetic resin stopper portion 7*a* from the projecting portion 60.

Second Embodiment

As shown in FIGS. 15A-15D, a full open stopper 43 in the second embodiment includes the projecting portion 60 and the pair of the left and right bending pieces 62 which are identical to those of the first embodiment; and a rear bending piece 66 which is located in the rear portion of the projecting portion 60 (the position which is farther apart from the stopper receiving surface 82 relative to the stopper surface 62*a* of the bending piece 62), and which is a protruding portion formed by bending in the upward direction to protrude. The full open stopper 43 is formed into a block shape by molding the synthetic resin stopper portion 7*a* on the tip end portion of the core plate 6 including the projecting portion 60, both of the bending pieces 62, and the rear bending piece 66. The check link apparatus of the second embodiment is substantially identical to the apparatus of the first embodiment in most aspects as shown by the use of the same reference numeral. The repetitive illustrations are omitted.

In the second embodiment, even when the stopper receiving surface 82 and the full open stopper 43 become the one side abutting state when the door D is restricted to the full open position, the load is received by the wide stopper surface

62*a* of the bending pieces 62, like the first embodiment. Accordingly, it is possible to decrease the concentration of the load, and to suppress the cracking and the peeling-off of the synthetic resin stopper portion 7*a*. Moreover, the outer bending portions 62*b* of the bending pieces 62 confront the stopper receiving surface 82 of the case 8. Accordingly, the load acted to the bending pieces 62 is the compressive load. With this, it is possible to suppress the deformation of the bending pieces 62, and to improve the strength of the full open stopper 43. Furthermore, the deformation of the synthetic resin stopper 7*a* on the upper surface side of the projecting portion 60 is prevented by the rear bending piece 66 which is located at a position rearward of the stopper surfaces 62*a* of both of the bending pieces 62, and which has a large surface by being formed in the direction opposite to the bending direction of the both bending pieces 62 to have the width identical to the width of the bending projecting portion 60. With this, it is possible to surely suppress the peeling-off of the synthetic resin stopper portion 7*a* from the projecting portion 60.

Third Embodiment

As shown in FIGS. 16A-16D, a full open stopper 43 in a third embodiment includes the projecting portion 60 identical to that of the first embodiment; and an upwardly bending piece 621 which is located on the left side (on the lower side in FIG. 16B) of the front portion of the projecting portion 60, and which is bent in the upward direction; a downwardly bending piece 622 which is located on the right side (on the upper side in FIG. 16B) of the front portion of the projecting portion 60, and which is bent in the downward direction; a rear downwardly bending piece 661 which is located on the left side of the rear portion of the projecting portion 60, and which is a protruding portion formed by bending in the downward direction; and a rear upwardly bending piece 662 which is located on the right side of the rear portion of the projecting portion 60, and which is a protruding portion formed by bending in the upward direction. The full open stopper 43 is formed into the block shape by molding the synthetic resin stopper portion 7*a* on the tip end portion of the core plate 6 including the projecting portion 60, the bending pieces 621, 622, 661, and 662. The check link apparatus of the third embodiment is substantially identical to the apparatus of the first embodiment in most aspects as shown by the use of the same reference numeral. The repetitive illustrations are omitted.

In the third embodiment, when the stopper receiving surface 82 and the full open stopper 43 become the one-side abutting state when the door D is restricted to the full open position, the load is received by the large (wide) stopper surfaces 621*a* and 622*a* of the bending pieces 621 and 622, like the first embodiment. Accordingly, it is possible to decrease the concentration of the load, and to suppress the cracking and the peeling-off of the synthetic resin stopper portion 7*a*. Moreover, the outer bending portions 621*b* and 622*b* confront the stopper receiving surface 82 of the case 8. Consequently, the load acted to the bending pieces 621 and 622 is the compressive load. With this, it is possible to suppress the deformation of the bending pieces 621 and 622, and to improve the strength of the full open stopper 43. Moreover, the deformation of the synthetic resin stopper portion 7*a* which is located on the rear side of the bending pieces 621 and 622 of the projecting portion 60 is prevented by the rear bending pieces 661 and 662 which are located on the rear side of the stopper surfaces 621*a* and 622*a* of the bending pieces 621 and 622, and which are bent in directions opposite, respectively, to the bending directions of the bending pieces 621 and 622. That is, the synthetic resin stopper portion 7*a* is sandwiched between the bending piece 622 and bending piece 662. With this, it is possible to more surely suppress the peeling-off of the synthetic resin stopper portion 7*a* from the projecting portion 60.

Fourth Embodiment

As shown in FIGS. 17A-17D, a full open stopper 43 in a fourth embodiment includes the projecting portion 60 identical to that of the first embodiment; a pair of left and right upwardly bending pieces 623 which are located on the both sides of the front portion of the projecting portion 60, and which are bent in the upward direction; and a protruding portion 651 which is located on a substantially central surface of the projecting portion 60, which protrudes in the downward direction (the direction parallel to the stopper receiving surface 82) by cutting and rising the projecting portion 60, and which has a relatively large surface. The full open stopper 43 is formed into a block shape by molding the synthetic resin stopper 7*a* on the tip end portion of the core plate 6 including the projecting portion 60, both of the bending pieces 623, and the protruding portion 651. The check link apparatus of the fourth embodiment is substantially identical to the apparatus of the first embodiment in most aspects as shown by the use of the same reference numerals. The repetitive illustrations are omitted.

In the fourth embodiment, when the stopper receiving surface 82 and the full open stopper 43 become the one-side abutting state when the door D is restricted to the full open position, the load is received by the large stopper surfaces 623*a* of the bending pieces 623, like the first embodiment. With this, it is possible to decrease the concentration of the load, and to suppress the cracking and the peeling-off of the synthetic resin stopper portion 7*a*. Moreover, the outer bending portions 623*b* of the bending piece 623 confront the stopper receiving surface 82 of the case 8. Accordingly, the load acted to the bending pieces 623 is the compression load. With this, it is possible to suppress the deformation of the bending pieces 623, and to improve the strength of the full open stopper 43. Furthermore, the deformation of the synthetic resin stopper portion 7*a* located on the lower surface side of the projecting portion 60 is prevented by the protruding portion 651 which is located on the rear side of the stopper surfaces 623*a* of the bending pieces 623, which protrudes in a direction opposite to the bending direction of the bending pieces 623, and which has a relatively large surface. With this, it is possible to more surely suppress the peeling-off of the synthetic resin stopper portion 7*a* from the projecting portion 60. Moreover, the part of the synthetic resin stopper portion 7*a* is sandwiched by the hole of the protruding portion 651 which is formed between the bending pieces 623 and 623 on the rear side of the bending pieces 623 and 623, and the stopper surface 623*a* of the upper bending piece 623. With this, it is possible to suppress the position deviation of the synthetic resin stopper portion 7*a* with respect to the projecting portion 60, and thereby to more surely suppress the peeling-off of the synthetic resin stopper 7*a* from the projecting portion 60.

Although the invention has been described above by reference to certain embodiments of the invention, the invention is not limited to the embodiments described above. Following modifications and variations of the embodiments described above will occur to those skilled in the art in light of the above teachings.

(1) The boss portion 42 of the check link 4 may be pivotally mounted to the door D. The check structure 5 may be disposed on the body B.

(2) The number of the protruding portions 65, 651, 66, 661, and 662 may be varied.

The entire contents of Japanese Patent Application No. 2011-071998 filed Mar. 29, 2011 are incorporated herein by reference.

The scope of the invention is defined with reference to the following claims.

What is claimed is:

1. A door check link apparatus for a vehicle, the door check link apparatus comprising:

a case fixed to one of a door and a body of the vehicle;

a check link having a base end portion swingably connected to the other of the door and the body; and a shoe which is received within the case, and which is slidably abutted on a detent surface of the check link, the check link which is formed by molding a synthetic resin on a surface of a core plate made from a metal, and which includes the detent surface having a raised portion and a recessed portion that are located at a substantially central portion of a longitudinal direction, and that are formed in the longitudinal direction, and a full open stopper that is located at a tip end portion, and which is arranged to be abutted on a stopper receiving surface of the case, and thereby to restrict a full open position of the door, the check link being constituted by integrally forming the detent surface and the full open stopper, the full open stopper of the check link including a projecting portion which is located at a tip end portion of the core plate, and which has a width larger than a width of the detent surface in a lateral direction of said check link, at least one bending piece which is formed at a first end portion of the projecting portion that is near the stopper receiving surface of the case, and which has a stopper surface confronting the stopper receiving surface, and at least one protruding portion which is formed on the projecting portion at a position farther apart from the stopper receiving surface relative to the stopper surface of the bending piece, and which protrudes in a direction substantially parallel to the stopper receiving surface, the full open stopper being formed by molding the synthetic resin on the tip end portion of the core plate including the projecting portion, the bending piece, and the protruding portion.

2. The check link apparatus as claimed in claim 1, wherein the bending piece includes an outer bending portion confronting the stopper receiving surface of the case.

3. The check link apparatus as claimed in claim 1, wherein the protruding portion is formed on a surface of the projecting portion which is perpendicular to the bending direction of the bending piece by burring.

4. The check link apparatus as claimed in claim 1, wherein the protruding portion is formed on a surface of the projecting portion which is perpendicular to the bending direction of the bending piece by cutting and rising the projecting portion.

5. The check link apparatus as claimed in claim 1, wherein the protruding portion is formed by bending a second end portion of the projecting portion which is opposite to the first end portion of the projecting portion.

6. The check link apparatus as claimed in claim 1, wherein the full open stopper includes a pair of the bending pieces located on the both sides of a widthwise direction of the check link; and the pair of the bending pieces are bent in the same direction.

7. The check link apparatus as claimed in claim 6, wherein the protruding portion protrudes in a direction opposite to the bending direction of the bending piece.

8. The check link apparatus as claimed in claim 1, wherein the full open stopper includes a pair of the bending pieces located on both sides of a widthwise direction of the check link; and the pair of the bending pieces are bent in opposite directions.

9. The check link apparatus as claimed in claim 8, wherein the full open stopper includes a pair of the protruding portions bent in opposite directions.

* * * * *